US012736304B1

(12) United States Patent
Dicriscio

(10) Patent No.: US 12,736,304 B1
(45) Date of Patent: Sep. 15, 2026

(54) SHOTGUN BALANCER

(71) Applicant: Brad Dicriscio, Phoenixville, PA (US)

(72) Inventor: Brad Dicriscio, Phoenixville, PA (US)

( * ) Notice: Subject to any disclaimer, the term of this patent is extended or adjusted under 35 U.S.C. 154(b) by 0 days.

(21) Appl. No.: 18/733,837

(22) Filed: Jun. 4, 2024

(51) Int. Cl.
*F41C 27/22* (2006.01)

(52) U.S. Cl.
CPC ..... *F41C 27/22* (2013.01)

(58) Field of Classification Search
CPC ..... F41C 27/22; F41A 9/65
USPC ..... 42/97
See application file for complete search history.

(56) References Cited

U.S. PATENT DOCUMENTS 1,437,796 A * 12/1922 Fisher ..... F41C 27/22 42/1.06
2,140,945 A * 12/1938 Swartz ..... F41C 27/22 42/97
2,763,081 A * 9/1956 Huckabee ..... F41A 29/02 42/95
3,340,641 A * 9/1967 Recker ..... F41C 27/22 42/75.01
3,371,440 A * 3/1968 Cassell ..... F41A 9/72 42/106
3,604,136 A * 9/1971 Edwards ..... F41C 27/22 42/97
3,618,245 A * 11/1971 Pruonto ..... F41C 23/14 42/71.01
3,619,925 A * 11/1971 Martin ..... F41C 27/22 42/97
3,683,534 A * 8/1972 Davis ..... F41C 23/06 42/1.06
4,492,050 A * 1/1985 Kagehiro ..... F41A 21/28 42/1.06
4,602,449 A * 7/1986 Holmes ..... F41A 9/72 42/49.02
5,448,848 A * 9/1995 Moller ..... F41A 21/02 89/14.05
5,524,374 A * 6/1996 Gernstein ..... F41A 3/82 42/1.06
7,704,161 B2 * 4/2010 Lindner ..... A63B 60/24 473/297
8,448,371 B1 * 5/2013 Wilhelm ..... F41C 27/22 42/97

(Continued)

FOREIGN PATENT DOCUMENTS

IT 1159725 B * 3/1987 ..... A63B 60/42

OTHER PUBLICATIONS https://web.archive.org/web/20240518032313/https://www.briley.com/p-52228-side-kick-20-chamber-inserts-for-12-gauge-shotguns-410-bore-only.aspx.
https://web.archive.org/web/20220610012956/https://www.amazon.com/Butler-Creek-Plug-Shotgun-50001/dp/B002E6TOBI/.
https://web.archive.org/web/20220610005413/www.amazon.com/Carlsons-Universal-Shotgun-Plug-2pk/dp/B07M65C4YD.

*Primary Examiner* — John Cooper
(74) *Attorney, Agent, or Firm* — Muskin and Farmer LLC

(57) ABSTRACT

A shotgun balancer for use in a double barreled shotgun. The balancer can be inserted into a barrel that is not to be loaded with a shell and thus can be used to help attain a comfortable balance of the shotgun. In addition, adding a weight to a gun helps reduce the recoil felt by the shooter. The shotgun balancer can also be used as a training aid, as by increasing the weight of the shotgun a user can build up strength in his/her relevant muscles. Once the weight is removed, the user will find that the shotgun is easier to lift, move and swing. The balancer can have a rod and one or more adjustable weights which can slide along the rod in order to adjust the weight distribution of the balancer.

9 Claims, 6 Drawing Sheets

(56) References Cited

U.S. PATENT DOCUMENTS

| | | | | |
|---|---|---|---|---|
| 10,760,868 | B2 * | 9/2020 | Schwendemann | A63B 21/0414 |
| 2021/0207919 | A1 * | 7/2021 | Loubser | F41C 7/00 |
| 2021/0247160 | A1 * | 8/2021 | Packes, Jr. | F41A 33/00 |

* cited by examiner

SHOTGUN BALANCER

BACKGROUND OF THE INVENTION

Field of the Invention

The present general inventive concept is directed to a method and apparatus directed to a balancer.

Description of the Related Art

A double barreled shotgun does not require both barrels to be loaded and shot, as one barrel can remain empty while the other barrel is loaded.

SUMMARY OF THE INVENTION

It is an aspect of the present invention to provide a shotgun balancer.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
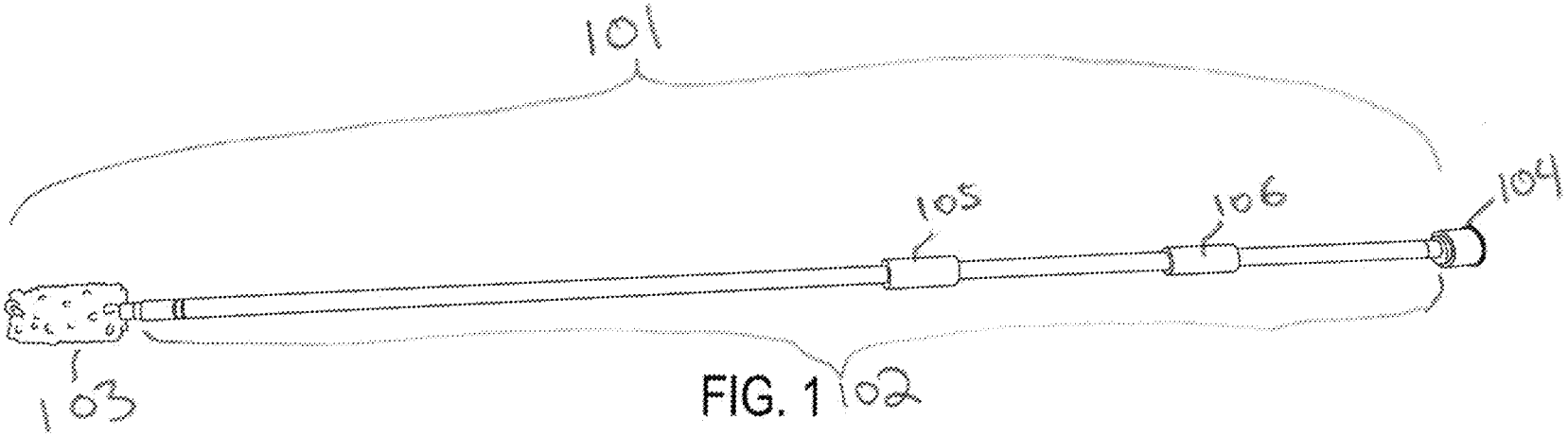
FIG. 1 is a drawing of a shotgun weight, according to an embodiment.

Reference will now be made in detail to the presently preferred embodiments of the invention, examples of which are illustrated in the accompanying drawings, wherein like reference numerals refer to like elements throughout.

When using a double barreled shotgun (both an over/under shotgun or a side by side shotgun), the user may decide to only load one barrel instead of both. In this situation, the empty barrel can be used with a weight to improve the balance of the gun as it is being utilized which can improve stability. A shotgun balancer is a rod that can be inserted into the empty barrel and can also have weight(s) which can move along the rod, thereby customizing the position of the sliders. The shotgun balancer can make it heavier and help distribute the weight(s). When the shotgun weight described herein is inserted into the empty barrel, it would increase the weight of the shotgun. The user would get used to the increased weight. Thus, once the shotgun weight is then removed, the user would find the shotgun lighter and easier to carry. The user can enhance his/her gun speed by temporarily inserting the weight/balancer into the barrel, swinging the gun through a shooting motion several times with the additional weight, and then removing the weight/balancer to allow for quicker response/swing while shooting.

FIG. 1 is a drawing of a shotgun weight, according to an embodiment.

A shotgun balancer 101 can be inserted into an empty barrel of a double barreled shotgun (not pictured in FIG. 1). The balancer 101 comprises an elongated rod 102. At one end of the rod 102 is a cleaning swab 103 which is inserted into the shot barrel to center it. At an opposite end of the rod is a cap 104. Also present on the rod 102 are weights, a first weight 105, and a second weight 106 which can slide along the rod 102 and be secured at a desired position along the rod 102. In one embodiment, the balancer 101 would be centered in the center of the barrel. In an embodiment, additional weights can be added. Alternatively, all of the weights 105, 106 can be removed and only the rod 102 can be used (for minimal weight).

Figure 2:
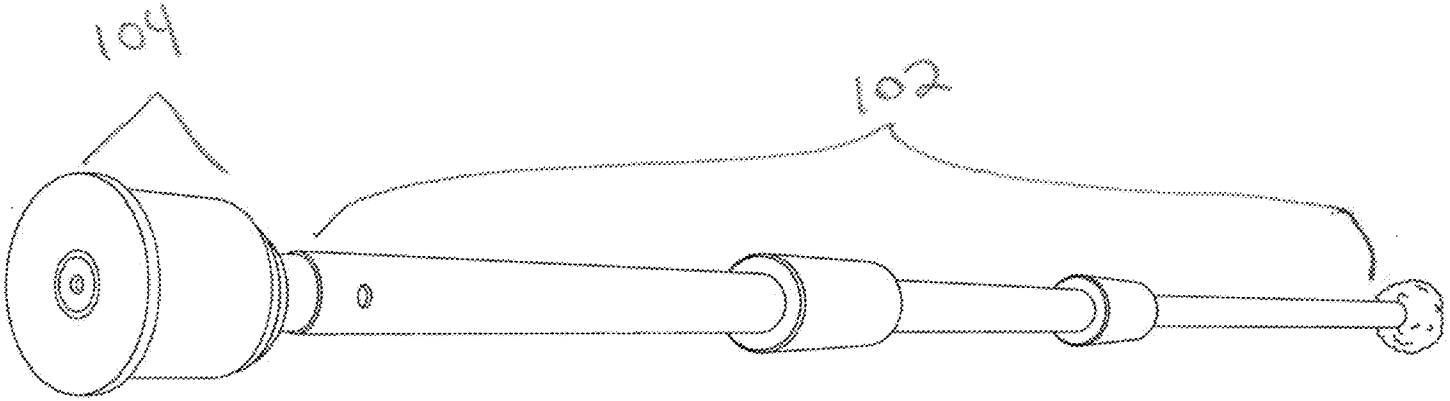
FIG. 2 is another drawing of a shotgun weight, according to an embodiment.

FIG. 2 is another drawing of a shotgun weight, according to an embodiment.

The cap 104 is shown which rests flush against the opening of the shot barrel.

Figure 3:
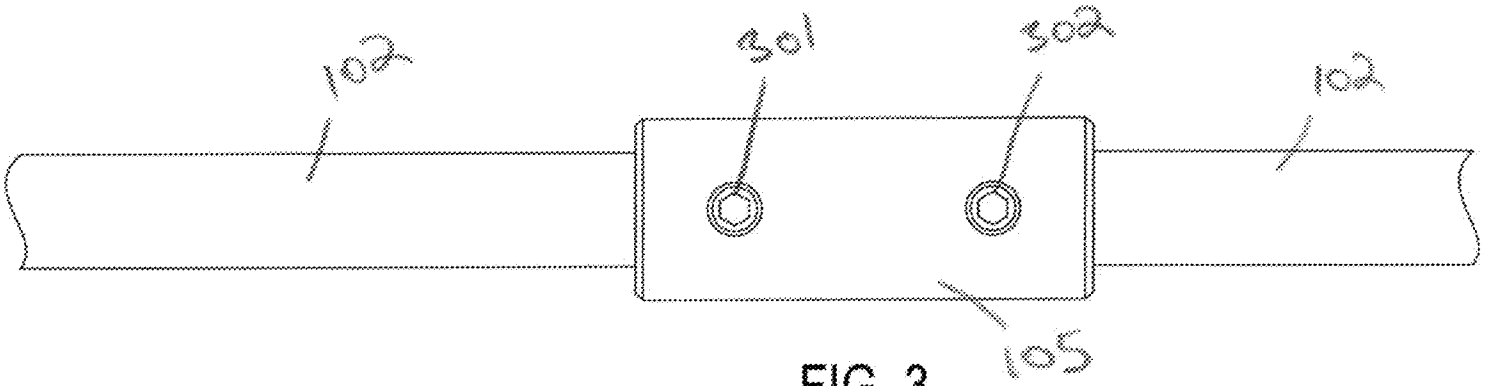
FIG. 3 is an enlarged drawing of a weight, according to an embodiment.

FIG. 3 is an enlarged drawing of a weight, according to an embodiment.

Note that the weight has two holes (not visible in FIG. 3) and two (set) screws 301, 302 which fit through the respective holes. The screws can be turned to loosen them and then the first weight 105 can be slid along the rod 102, and when the first weight 105 is in the desired position, the screws 301, 302 can be tightened in order to secure the first weight 105 on the rod 102. When each screw is tightened, an end of the screw presses tightly against the rod 102 thereby preventing the respective weight from sliding along the rod 102. When each screw is loosened, the end of the screw loses contact with the 102 thereby enabling the weight to slide along the rod 102. The second weight 106 has the identical structure to the first weight 105 including the holes and screws. The positions of both weights, the first weight 105 and the second weight 106 can be adjusted in this manner. The user would adjust the weights 105, 106 to desired positions in order that the balance of the shotgun is to his/her liking and is comfortable, which also allows for the faster or slower swing of the gun. Any number of such weights 105, 106 can be used. Such weights can be added or removed as desired by the user. Note that the weights can weigh any suitable amount such as 5 grams, and can typically be in the range from 5 to 50 grams.

Figure 4:
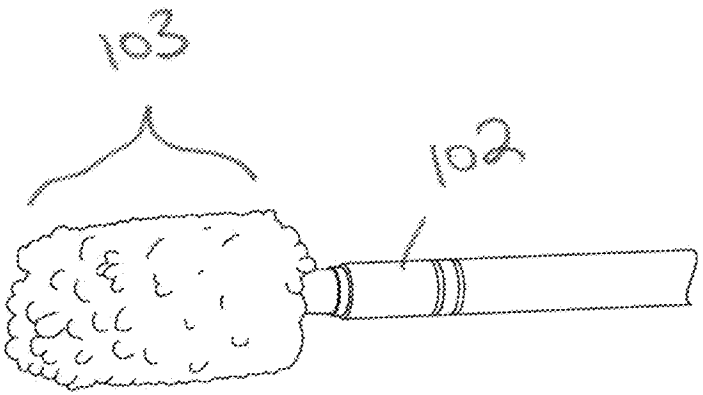
FIG. 4 is a drawing of a first end of the shotgun weight with a cleaning swab, according to an embodiment.

FIG. 4 is a drawing of a first end of the shotgun weight with a cleaning swab, according to an embodiment.

The cleaning swab 103 can be any utensil which can be used to clean the inside of the barrel, and can be a duster, sponge, brush, etc.

Figure 5:
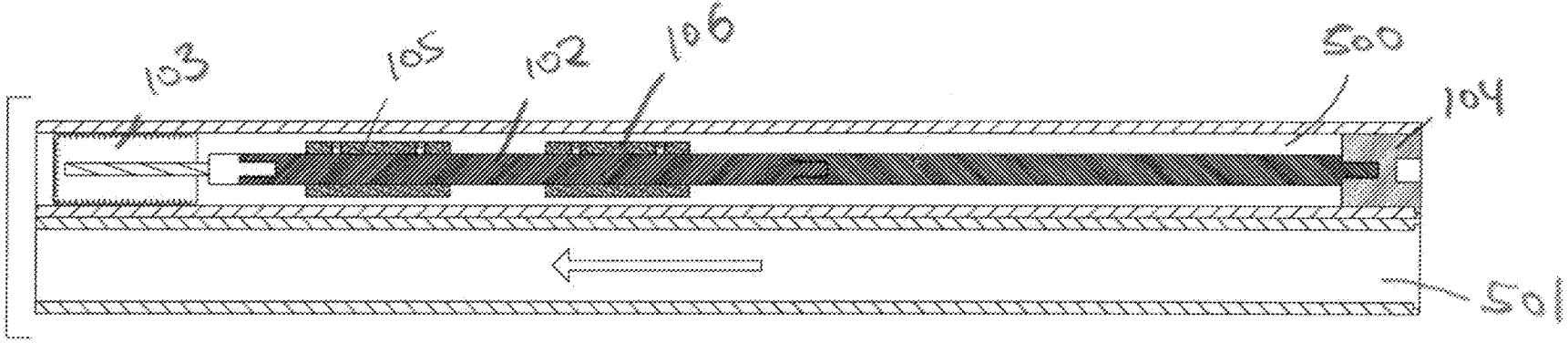
FIG. 5 is a cross section of a double barrel shotgun with a shotgun weight inserted, according to an embodiment.

FIG. 5 is a cross section of a double barrel shotgun with a shotgun weight inserted, according to an embodiment.

An unloaded barrel 500 (which is not loaded with a shell) and a loaded (active) barrel 501 are parts of a shotgun. The arrow in the loaded barrel 501 shows the direction of the shot. The cleaning swab 103, first weight 105, second weight 106, and cap 104 are shown inside the unloaded barrel 500. The cap 104 is shaped with a rim to prevent the balancer 101 from being pushed further into the unloaded barrel 500 as the rim rests against the end of the unloaded barrel 500 (typically in a recessed notch/groove). As the balancer 101 is inserted into the unloaded barrel 500, the cleaning swab 103 would absorb any dust and particles present inside the unloaded barrel and also help keep the balancer 101 stable and secure. The first weight 105 and second weight 106 would have been adjusted by the user before the balancer 101 was inserted into the unloaded barrel 500. Any number of such weight(s) can be used. The rod 102 can optionally come in two sections, being joined by a threaded rod (male) and a female threaded portion so that the two sections can screw together. The end of the rod 102 which connects to the cap 104 can also be threaded and the cap can be threaded to receive the threaded end of the rod 102.

Figure 6:
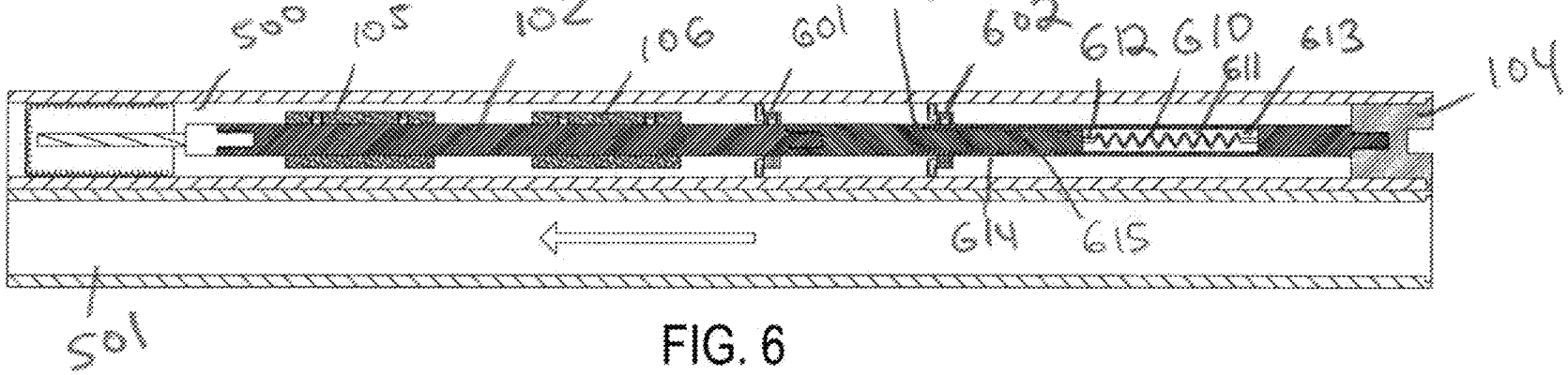
FIG. 6 is a cross section of a double barrel shotgun with a shotgun weight which includes a spring and spacers, according to an embodiment.

FIG. 6 is a cross section of a double barrel shotgun with a shotgun weight which includes a spring and spacers, according to an embodiment.

The rod 102 can be inserted into optional spacers 601, 602. The spacers 601, 602 can be slid along the rod 102 to a desired position and would fit tight around the rod 102 so that the spacers 601, 602 would typically not slide unless manually pushed. Spacers can have a set screw (like the weights) to keep them in place. Any number of such spacers 601, 602 can be used (e.g., from 0 to 5 or more). The spacers serve to stabilize the rod 102 and keep it centered inside the unloaded barrel 500 and reduce vibrations (especially when a shot is fired out of the loaded barrel 501). Since the spacers are sized such that they gently touch the inner surface of the unloaded barrel, the rod 102 would not have the ability to shake inside the unloaded barrel 500. Any number of such spacers 601, 602 can be used. The spacers can each weigh from 5 to 10 grams.

In an embodiment, a spring 610 (such as a tension spring) can be used to allow the weights to move relative to the shotgun and naturally return to their initial position by virtue of the spring tension. A hollow inner section 611 is located inside the rod 101. The spring 610 is located inside the hollow inner section 611. A first end 613 of the spring 610 is connected to an end of the hollow inner section 611. A second end 612 of the spring 610 (opposite the first end 613) is attached to a smaller section 615 of the rod 101. The smaller section 615 is located inside an outside perimeter 614 of the rod 101. The smaller section 615 is able to slide in the direction of the elongation of the rod within the outside perimeter 614. The spring 610 would enable the smaller section 615 (and hence the portion of the rod 101 connected to the smaller section 615) to move in a direction away from the cap 104 while the cap 104 remains secured at the end of the unloaded barrel 500. The natural force of the spring would recoil the smaller section 615 (and hence the portion of the rod 101 connected to the smaller section 615) back to the natural position (shown in FIG. 6). Therefore, upon active (loaded) barrel of the shotgun being fired, the smaller section 615 of the rod 101 and the portion of the rod 101 connected to the smaller section 615 would move in the direction of the elongation of the rod and recoil by virtue of the spring, thereby absorbing energy from the shot. This would prevent the rod 101 and gun from breaking or stressing (reducing stress on the gun) since the energy from the shot is absorbed by the spring.

Figure 8:
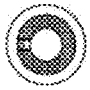
FIG. 8 is a drawing of a rear of a spacer.
Figure 7:
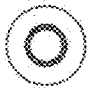
FIG. 7 is a drawing of a front of a spacer.

FIG. 7 is a drawing of a front of a spacer. FIG. 8 is a drawing of a rear of a spacer. Each spacer would friction fit tightly around the rod 102 and/or use set screw(s) to tighten them around the rod to hold their position. In an embodiment, each spacer can be able manually slide along the rod 102 when pushed/pulled by the user. The outer circumference of the spacer would be sized to contact the inner surface of the unloaded barrel 500, thereby preventing the spacer (and hence the rod 102) from moving in a plane orthogonal to the direction of the rod.

Figure 9:
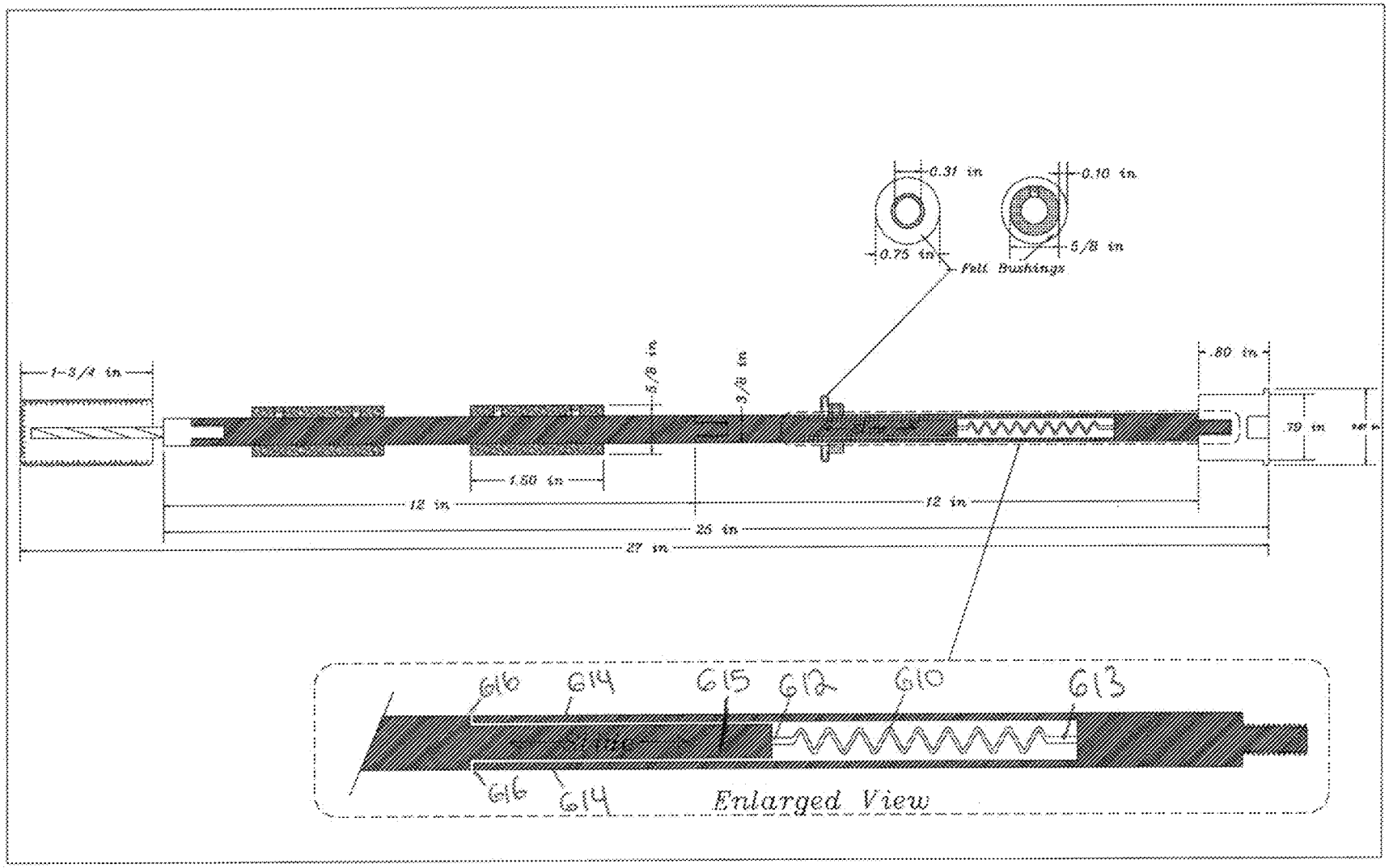
FIG. 9 is a cross section of a shotgun weight showing exemplary measurements, according to an embodiment.

FIG. 9 is a cross section of a shotgun weight showing exemplary measurements, according to an embodiment. Note that the measurements shown are merely exemplary and it can be appreciated that other suitable measurements can be used as well. FIG. 9 also shows an enlarged view of the spring 610 and surrounding structures. A small gap 616 (empty space) is located on both sides (top and bottom) between the smaller section 615 and the outside perimeter 614. This allows the smaller section 615 to move in the leftward direction when the gun is fired, and the spring 610 then recoils the smaller section 615 back to is natural position (as shown in FIG. 9).

Note that any suitable materials can be used to construct any of the parts described herein such as metal, aluminum, hard plastic, brass, ceramic, etc.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An apparatus, comprising:
a rod;
a cap located at a first end of the rod;
a weight around the rod, the weight configured to be slidable along the rod; and
a screw inside the weight configured to secure the weight to the rod,
wherein the rod further comprises:
a hollow inner section comprising a first end of the inner section and a second end of the inner section opposite the first end of the inner section;
a smaller section of the rod comprising the second end of the inner section, wherein the smaller section has a smaller diameter than a remaining portion of the rod; and
a spring connecting the first end of the inner section to the second end of the inner section, configured to enable the smaller section to move away from the first end of the inner section.

2. The apparatus as recited in claim 1, wherein the weight weighs in a range from 5 to 50 grams.

3. The apparatus as recited in claim 1, further comprising:
a shotgun, wherein the rod is inserted inside the shotgun.

4. The apparatus as recited in claim 1, further comprising a cleaning swab located at a second end of the rod, the second end of the rod being opposite the first end of the rod.

5. The apparatus as recited in claim 1, further comprising a spacer configured to slide along the rod.

6. A method, comprising:
inserting a balancer inside a first barrel of a double barreled shotgun, the balancer comprising:
a rod;
a cap located at a first end of the rod;
a weight around the rod, the weight configured to be slidable along the rod; and a screw inside the weight configured to secure the weight to the rod, wherein the rod further comprises:

a hollow inner section comprising a first end of the inner section and a second end of the inner section opposite the first end of the inner section;

a smaller section of the rod comprising the second end of the inner section, wherein the smaller section has a smaller diameter than a remaining portion of the rod;

a spring connecting the first end of the inner section to the second end of the inner section, configured to enable the smaller section to move away from the first end of the inner section.

7. The method as recited in claim 6, wherein the weight weighs in a range from 5 to 50 grams.

8. The method as recited in claim 6, wherein the balancer further comprises a cleaning swab located at a second end of the rod, the second end being opposite the first end of the rod.

9. The method as recited in claim 6, wherein the balancer further comprises a spacer configured to slide along the rod.

* * * * *